US006152549A

United States Patent [19]

Goto et al.

[11] Patent Number: 6,152,549

[45] Date of Patent: Nov. 28, 2000

[54] FRAMELESS SLIDING DOOR SYSTEM FOR A TELEVISION CABINET STAND

[75] Inventors: Hirokazu Goto, San Diego; Shunsuke Hanaoka, Poway; Jared Lee Zamaloff, San Diego, all of Calif.; Richard Gioscia, Mahwah, N.J.

[73] Assignees: Sony Corporation, Tokyo, Japan; Sony Electronics, Inc., Park Ridge, N.J.

[21] Appl. No.: 09/189,769

[22] Filed: Nov. 10, 1998

[51] Int. Cl.[7] ..... A47B 81/06

[52] U.S. Cl. ..... 312/223.1; 312/139.2; 312/349; 49/370; 49/410

[58] Field of Search ..... 312/7.2, 139.2, 312/349, 223.1; 49/370, 410

[56] References Cited

U.S. PATENT DOCUMENTS

| | | | |
|---|---|---|---|
| D. 320,126 | 9/1991 | Miller | D6/436 |
| 1,610,282 | 12/1926 | Hansen | 49/410 |
| 1,893,105 | 1/1933 | Raaen | 49/410 |
| 2,485,296 | 10/1949 | Lescaze | 49/410 X |
| 3,166,801 | 1/1965 | Provenzo | 49/410 X |
| 3,702,521 | 11/1972 | Peterson | 49/410 X |
| 4,513,535 | 4/1985 | Uphoff | 49/410 X |
| 4,836,625 | 6/1989 | Catta | 312/7.2 X |
| 4,861,121 | 8/1989 | Gotz | 312/7.2 X |

FOREIGN PATENT DOCUMENTS

| | | | |
|---|---|---|---|
| 2672482 | 8/1992 | France | 312/139.2 |
| 3300736 | 7/1984 | Germany | 312/139.2 |
| 403047387 | 2/1991 | Japan | 49/410 |
| 0196048 | 5/1938 | Switzerland | 312/139.2 |
| 9959 | of 1903 | United Kingdom | 49/410 |
| 398489 | 9/1933 | United Kingdom | 49/410 |

*Primary Examiner*—Peter M. Cuomo
*Assistant Examiner*—David E. Allred
*Attorney, Agent, or Firm*—Blakely, Sokoloff, Taylor & Zafman LLP

[57] ABSTRACT

A frameless sliding door system for a television cabinet stand having a top board coupled to two vertical guide mounts. The frameless sliding door system has two doors, each door having top and bottom bearing rail mechanism that permits the doors to move horizontally away and towards one another, but fixes the movement of the doors in other directions. Other features are disclosed.

6 Claims, 4 Drawing Sheets

FRAMELESS SLIDING DOOR SYSTEM FOR A TELEVISION CABINET STAND

BACKGROUND OF THE INVENTION

1. Field of the Invention

The present invention relates generally to television stands, and more particularly to a frameless sliding door for a television cabinet stand.

2. Prior Art

Conventional digital television (DTV) stands typically have a boxed shaped construction comprising four walls, perpendicularly adjacent to one another. Where the stand also serves as a cabinet, the cabinet has doors that are locked to the cabinet by magnets. The doors to the cabinet are then opened by pushing in on the door to unlock the magnet lock and then pivoting the doors out and away from the cabinet. This is inconvenient as the open doors force the user to back away from the cabinet. Moreover, the doors must be fully open before equipment can be installed into or removed from the cabinet interior. On closing the doors, the magnet locking device may not catch so as to leave the doors open to partially swing back.

The foot of a television stabilizes the television on top of the cabinet stand. Just above the foot on the front of a conventional television is a set controls door that controls access to most of the manual controls of the television. Typically, the foot is inset behind the doors of the cabinet so as to form a jog. This jog forms a gap that may permit the set controls door to be opened further than designed. By being opened further than designed, the set controls door may break off.

Thus, in a television cabinet stand, there is a need for a frameless sliding door that remains flush with the face of the cabinet on being opened and a foot cover that eliminates the problems of the jog gap.

BRIEF SUMMARY OF THE INVENTION

The invention relates to a frameless sliding door system for a television cabinet stand having a top board coupled to two vertical guide mounts. The frameless sliding door system has two doors, each door having top and bottom bearing rail mechanism that permits the doors to move horizontally away and towards one another, but fixes the movement of the doors in other directions. Other features are disclosed.

DETAILED DESCRIPTION OF THE INVENTION

For purposes of explanation, specific embodiments are set forth to provide a thorough understanding of the present invention. However, it will be understood by one skilled in the art, from reading this disclosure, that the invention may be practiced without these details. Moreover, well-known elements, devices, process steps and the like are not set forth in detail in order to avoid obscuring the present invention.

Figure 1:
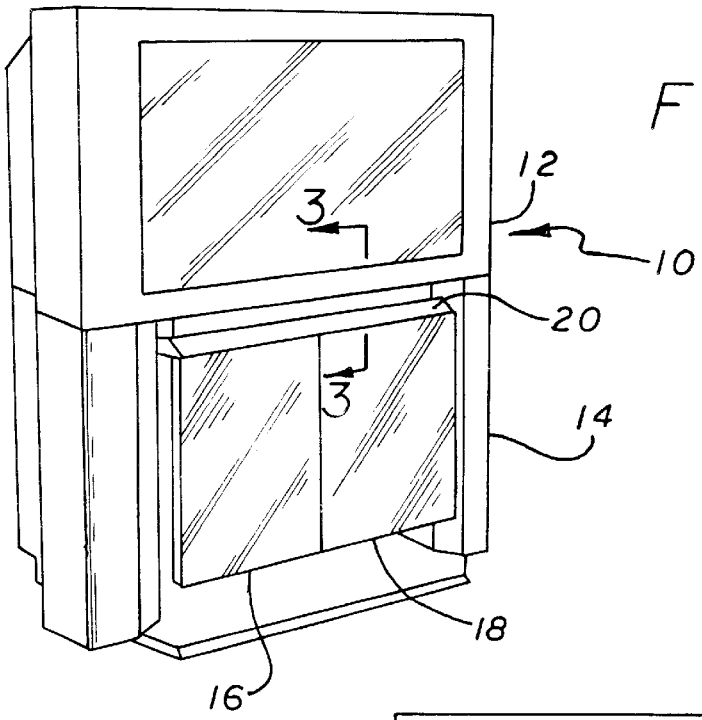
FIG. 1 is an isometric view of an embodiment of the present invention.

Reference is now made to FIGS. 1 through 5 to illustrate the embodiments of the invention. FIG. 1 is an isometric view of an embodiment of the present invention. Entertainment center 10 comprises digital television 12 being supported by cabinet stand 14. The support includes a place on which to locate digital television 12 and an accessible enclosure place in which to locate auxiliary service devices that enhance the features of television 12. Such devices may include video cassette recorders and sound enhancing devices.

To help form an accessible enclosure within cabinet stand 14, left door 16 and right door 18 are moveably attached to cabinet stand 14 as discussed below. Cover 20 shown in FIG. 1 serves to aid the movement of the doors as discussed below in connection with FIG. 3.

Figure 2:
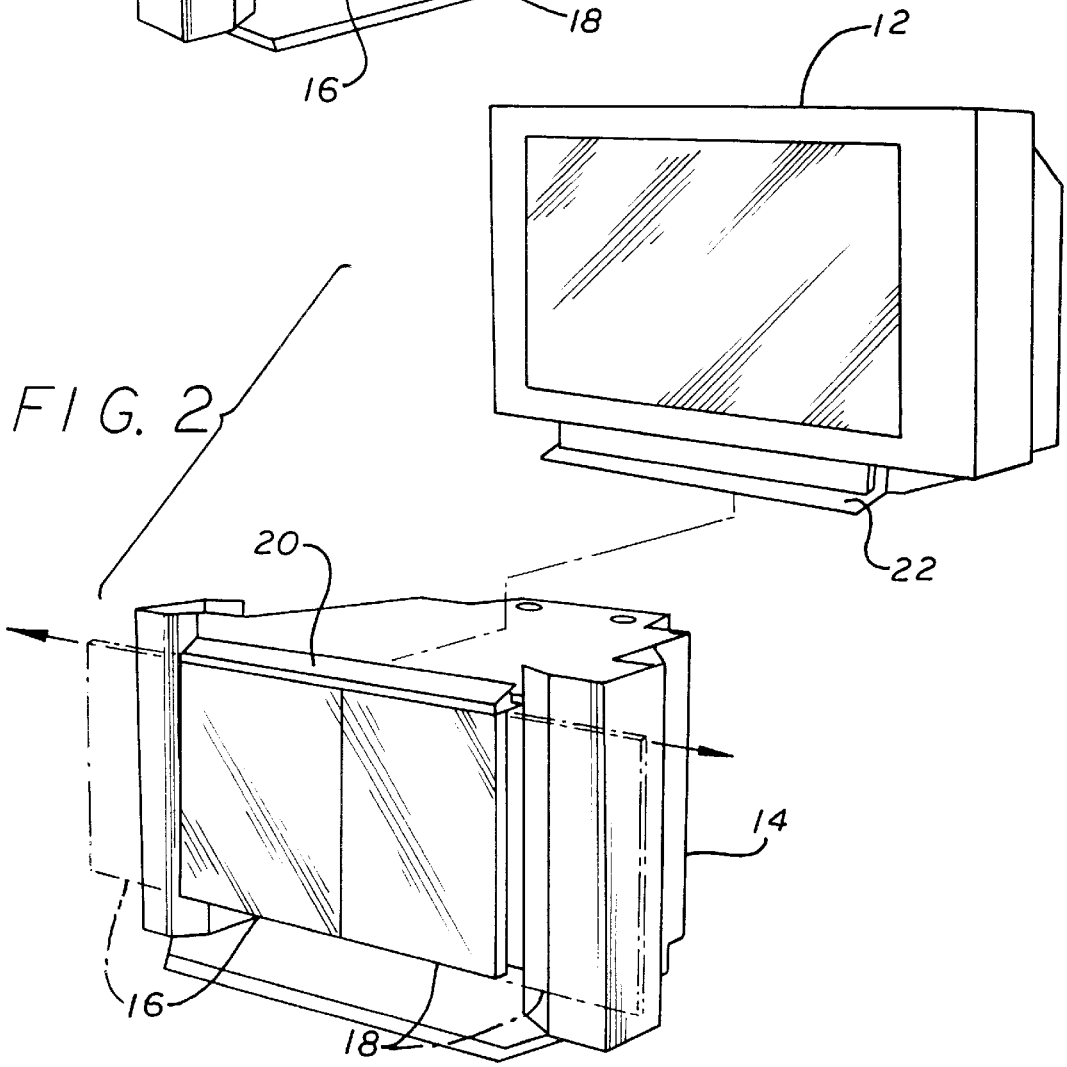
FIG. 2 is an exploded view of an entertainment center showing a digital television removed from a cabinet stand.

FIG. 2 is an exploded view of entertainment center 10 showing digital television 12 removed from cabinet stand 14. As shown, television 12 is assembled onto cabinet stand 14 by moving foot 22 of television 12 into cover 20. Preferably, left door 16 and right door 18 move away from one another in the directions shown by the arrows.

Figure 3:
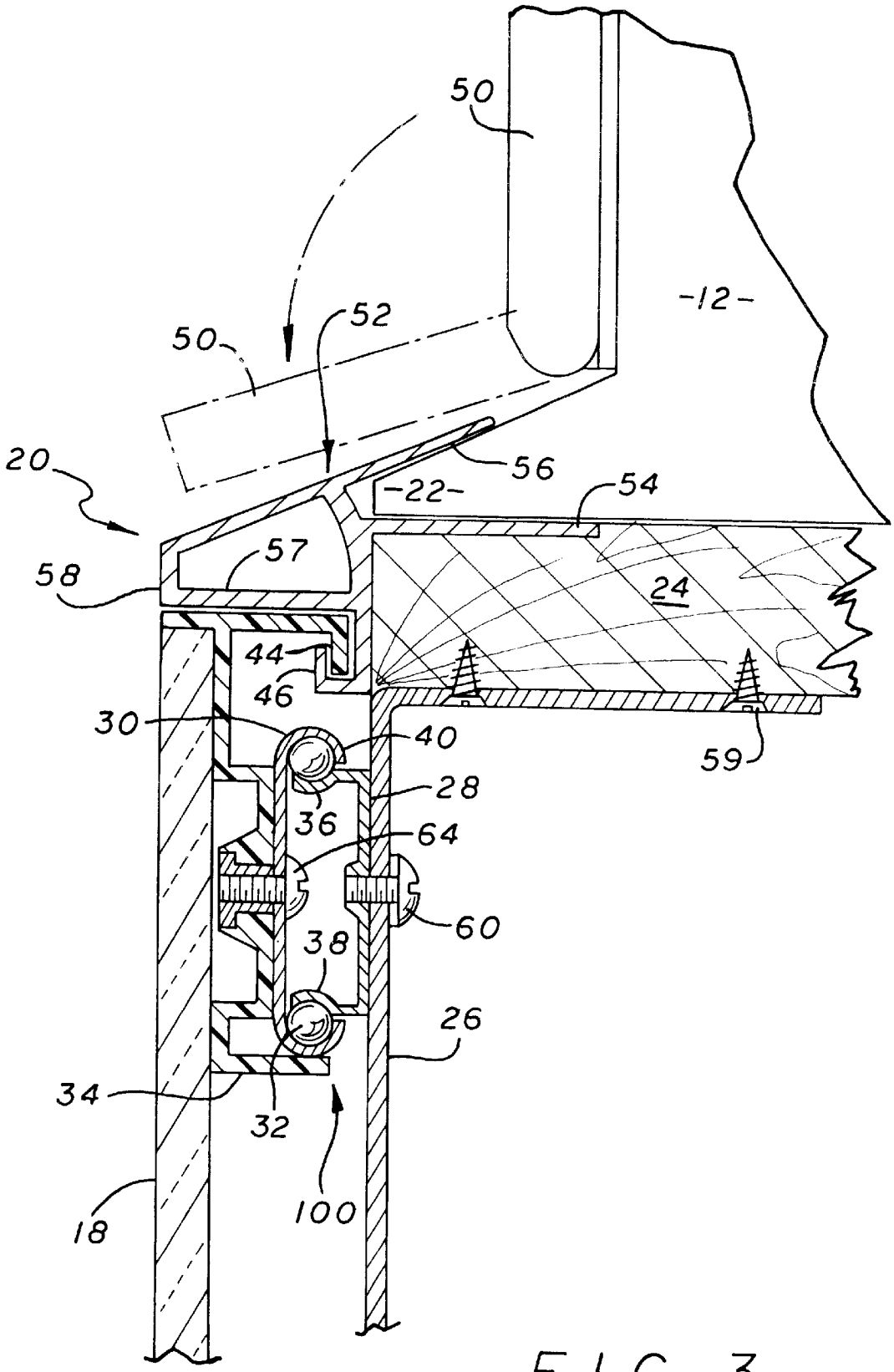
FIG. 3 is a section view of sliding doors of the present invention taken generally off of line 3—3 of FIG. 1.

FIG. 3 is a section view of the sliding door of the present invention taken generally off of line 3—3 of FIG. 1. To directly support television 12, top board 24 is provided. To eliminate the frame that accompanies most cabinet stands, two guide mounts 26 are attached to and extend down from top board 24 so as to provide a stable, secure platform onto which the left door 16 and right door 18, respectively, may be mounted.

Preferably made of acrylic, left door 16 and right door 18 are moveably fixed to guide mounts 26 by a similar rail mechanism. Rail mechanism 100 by which right door 18 shown in FIG. 3 is moveably fixed to guide mount 26 comprises guide rail 28, guide 30, bearings 32, door frame 34, and cover 20, and associated hardware discussed in further detail in connection with FIG. 4.

As shown in FIG. 3, guide rail 28 may be a U-shaped extrusion wherein top prong 36 and bottom prong 38 are curved outward to form a surface over which each bearing 32 may roll. Guide 30 may also be a U-shaped extrusion in which top projection 40 and bottom projection 42 are curved inward to form a surface over which each bearing 32 may roll. In this way, bearings 32 may be coupled between top prong 36 and top projection 40 guide 30 and coupled between bottom prong 38 and bottom projection 42. Bearings 32 permit guide 30 to move in horizontal relationship to stationary guide rail 28 while remaining fixed to guide rail 28 in other directions.

In a preferred embodiment, four rail mechanisms 100 are used, two rail mechanisms 100 for each door, one rail mechanism 100 at the top of a door and one rail mechanism 100 at the bottom of that same door. Limits (not shown) are placed at the ends of each guide rail 28 to maintain a known horizontal movement of each door. Preferably, guide 30, guide rail 28, and bearings 32 are made of a metallic material for longer life.

To attach right door 18 to the moveably fixed guide 30, door frame 34 may attached between guide 30 and right door 18 near the top of right door 18. Preferably, door frame 34 is fixed to right door 18 by adhesive. For rail mechanism 100 located at the top of the doors, hook 44 that engages guide 46 of cover 20 is provided to further ensure a true horizontal movement of the doors.

Cover 20 may be an extruded piece that extends the length of foot 22 of television 12. In addition to helping to guide the movement of each door, cover 20 may serve to eliminate the gap that may permit set controls door 50 to be opened further than designed. Cover 20 comprises V-shaped wedge 52 formed from extension 54 and extension 56 into which foot 22 may be inserted. To provide television 12 with a flat surface, top board 24 may have a recess cut to a depth that matches the thickness of extension 54. Cover 20 also comprises bottom piece 57 that extends between guide 46 and front 58 of cover 20. To form an angled surface onto which set control door 50 may rest, extension 56 extends to intersect with front 58.

Figure 4:
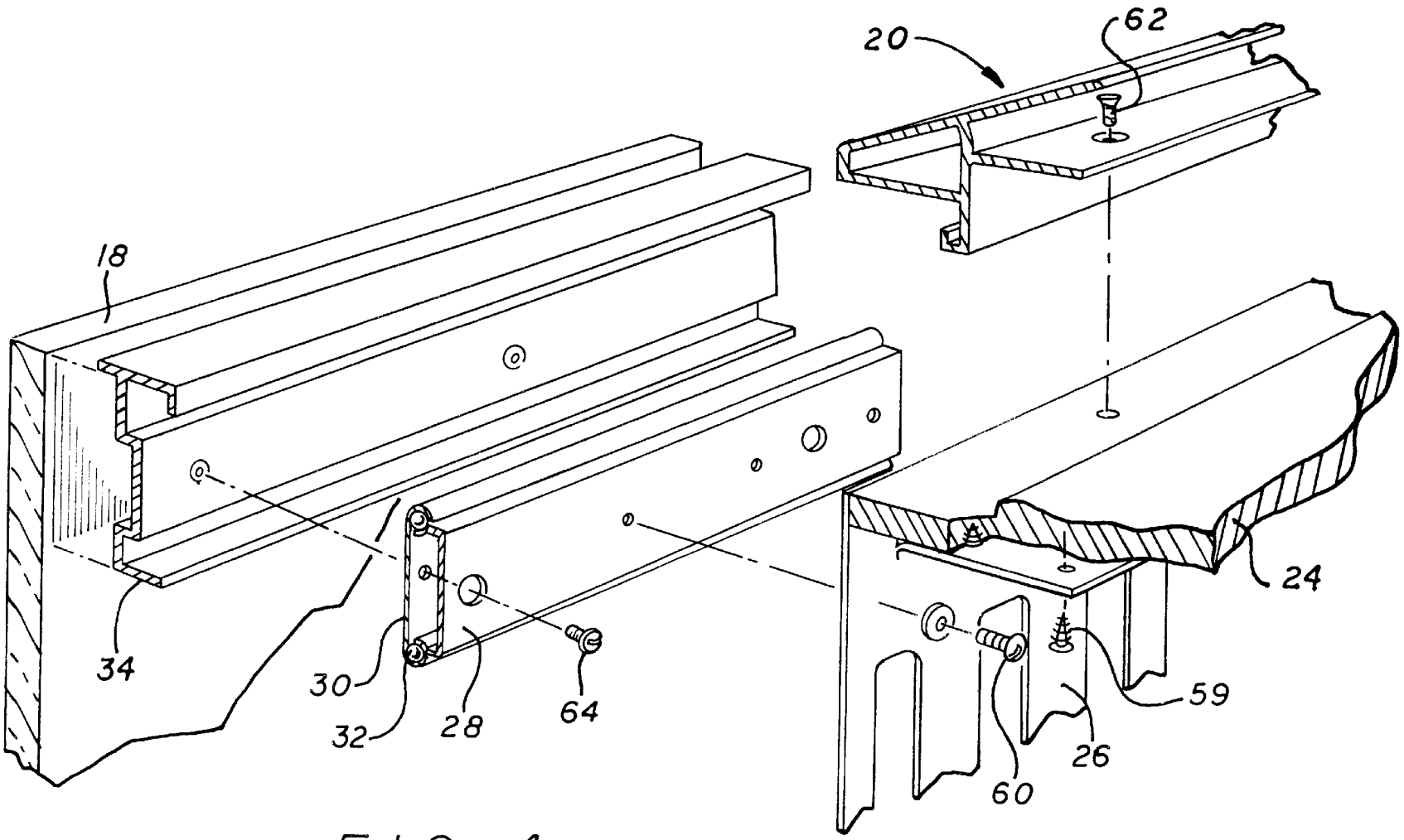
FIG. 4 is an exploded assembly view of the upper right door of the present invention.

FIG. 4 is an exploded assembly view of the upper right door of the present invention. Guide mount 26 may be attached to top board 24 by screws 59 distributed along the width of guide mount 26. Guide rail 28 may be attached to guide mount 26 through screws 60 distributed along the width of guide mount 26. Cover 20 may then be attached to top board 24 using a plurality of screws 62 that are distributed along the length of cover 20. With guide 30 assembled to guide rail 28, this assembly may be mounted to door frame 34 by a plurality of screws 64 distributed along the length of guide 30.

Figure 5:
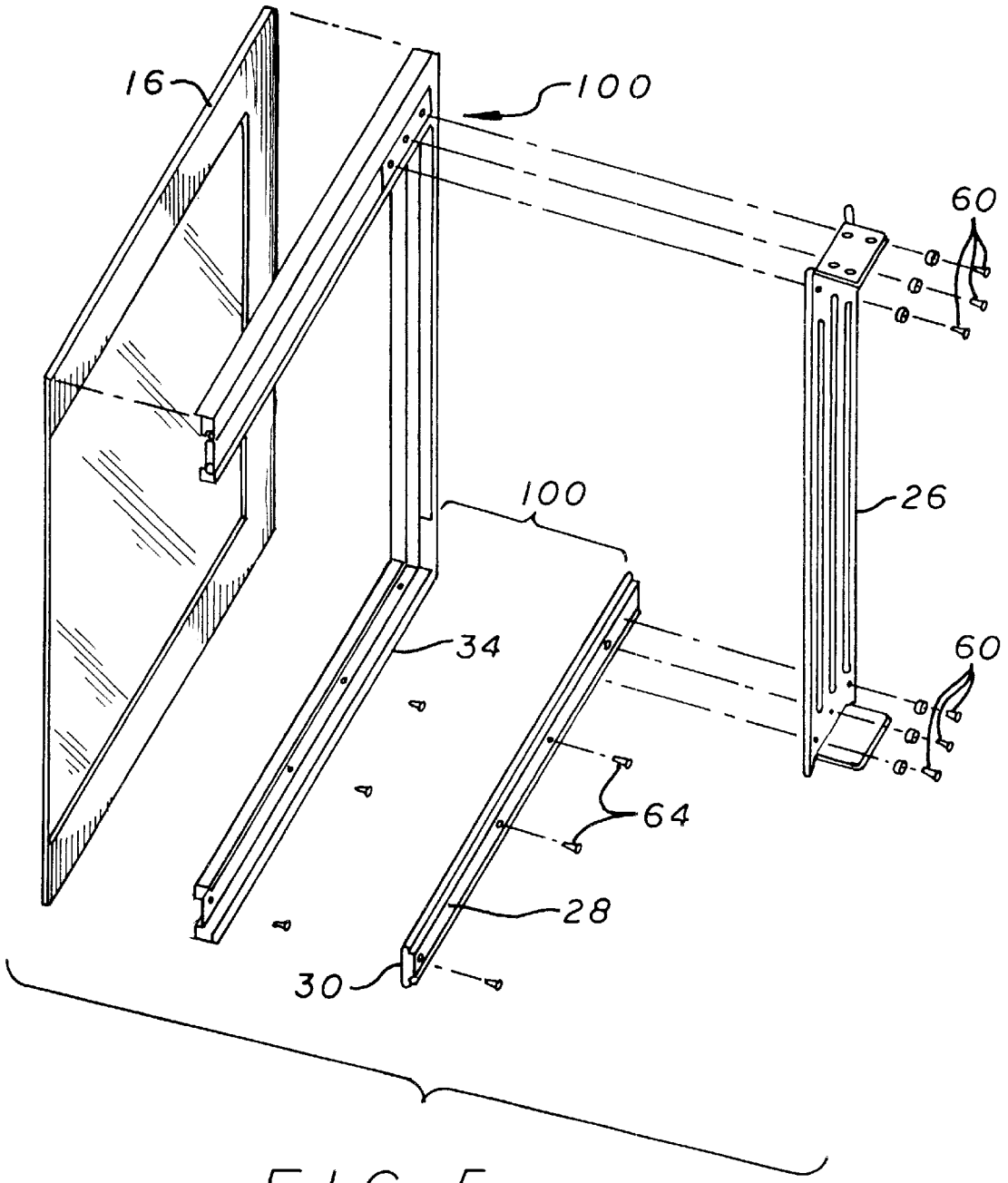
FIG. 5 is an exploded assembly view of the left door of the present invention.

FIG. 5 is an exploded assembly view of left door 16 of the present invention. As shown, guide mount 26 is orientated vertical and attached to rail mechanism 100 at the top left hand side of left door 16 by three screws 60 and at the bottom left hand side of left door 16 by three screws 60. Similar to right door 18 discussed in connection with FIG. 4, guide rail 28 is attached to door frame 34 by attaching guide 30 to door frame 34 through screws 64.

While the present invention has been particularly described with reference to the various Figures, it should be understood that the Figures and detailed description, and the identification of certain preferred and alternate materials, are for illustration only and should not be taken as limiting the scope of the invention or excluding still other alternatives. Many changes and modifications may be made to the invention, by one having ordinary skill in the art, without departing from the matter and scope of the invention.

What is claimed is:

1. In a television cabinet stand having a top board coupled to a first guide mount and a second guide mount, a frameless sliding door system comprising:

said first and second guide mounts each extending longitudinally in a vertical direction;

a first, second, third, and fourth rail mechanism, each rail mechanism having a guide rail, a guide moveably mounted to the guide rail, and a door frame coupled to the guide, the guide rail of the first and the third rail mechanisms coupled to upper and lower ends of the first guide mount respectively and the second and the fourth rail mechanisms coupled to upper and lower ends of the second guide mount respectively;

a left door having a top and a bottom, the left door coupled to a respective said door frame of the first rail mechanism at the top of the left door and coupled to a respective said door frame of the third rail mechanism at the bottom of the left door;

a right door having a top and a bottom, the right door coupled to a respective said door frame of the second rail mechanism at the top of the right door and coupled to a respective said door frame of the fourth rail mechanism at the bottom of the right door; and a plurality of bearings, wherein the first door and the second door are made of acrylic, wherein each guide rail is a U-shaped extrusion, each U-shaped extrusion of each guide rail having a top prong curved outward and a bottom prong curved outward, wherein each guide is a U-shaped extrusion, each U-shaped extrusion of each guide having a top projection curved inward to form a top prong projection combination with a respective said top prong curved outward and a bottom projection curved inward to form a bottom prong projection combination with a respective said bottom prong curved outward, wherein the plurality of bearings are disbursed between each top prong projection combination with a respective said top prong curved outward and disbursed between each bottom prong projection combination with a respective said bottom prong curved outward, wherein each guide, guide rail, and the plurality of bearings are made of a metallic material, and wherein the door frame of the first rail mechanism and the door frame of the second rail mechanism each have a hook;

each said hook extending rearwardly and downwardly relative to said cabinet stand above a respective said guide;

a cover mounted on a front and top surface of said top board, said cover comprising a V-shaped wedge with an upper extension extending upwardly and rearwardly of a top surface of said top board and forwardly and downwardly of said top surface, said cover also including a guide into which each said hook extends.

2. The system of claim 1 wherein each door frame is coupled to each door by adhesive.

3. In a television cabinet stand having a top board coupled to a first guide mount and a second guide mount, a frameless sliding door system comprising:

said first and second guide mounts each extending longitudinally in a vertical direction;

a first, second, third, and fourth rail mechanism, each rail mechanism having a guide rail, a guide moveably mounted to the guide rail, and a door frame coupled to the guide, the guide rail of the first and the third rail mechanisms coupled to upper and lower ends of the first guide mount respectively and the second and the fourth rail mechanisms coupled to upper and lower ends of the second guide mount respectively;

a left door having a top and a bottom, the left door coupled to a respective said door frame of the first rail mechanism at the top of the left door and coupled to a respective said door frame of the third rail mechanism at the bottom of the left door; and a right door having a top and a bottom, the right door coupled to a respective said door frame of the second rail mechanism at the top of the right door and coupled to a respective said door frame of the fourth rail mechanism at the bottom of the right door, wherein the door frame of the first rail mechanism and the door frame of the second rail mechanism each have a hook, the system further comprising a cover;

each said hook extending rearwardly and downwardly relative to said cabinet stand above a respective said guide;

a cover mounted on a front and top surface of said top board, said cover comprising a V-shaped wedge with an upper extension extending upwardly and rearwardly of a top surface of said top board and forwardly and downwardly of said top surface, said cover also including a guide into which each said hook extends.

4. The system of claim 3 wherein the cover further comprises said V-shaped wedge wherein said upper extension comprises a first extension residing above a second extension.

5. The system of claim 4 wherein the first extension of the cover extends to form an angled surface.

6. The system of claim 5 wherein the cover is attached to the top board with a plurality of screws that are distributed along the length of the cover.

* * * * *